US011772929B1

(12) United States Patent
Langeman

(10) Patent No.: US 11,772,929 B1
(45) Date of Patent: Oct. 3, 2023

(54) CORE INSERT AND HAND TOOL FOR DISPENSING MATERIAL WOUND ON A CORE

(71) Applicant: Gary D. Langeman, Naples, FL (US)

(72) Inventor: Gary D. Langeman, Naples, FL (US)

( * ) Notice: Subject to any disclaimer, the term of this patent is extended or adjusted under 35 U.S.C. 154(b) by 0 days.

(21) Appl. No.: 17/899,055

(22) Filed: Aug. 30, 2022

(51) Int. Cl.
*B65H 75/08* (2006.01)
*B65H 16/04* (2006.01)

(52) U.S. Cl.
CPC ..... *B65H 75/08* (2013.01); *B65H 16/04* (2013.01); *B65H 2402/412* (2013.01); *B65H 2701/1944* (2013.01)

(58) Field of Classification Search
None
See application file for complete search history.

(56) References Cited

U.S. PATENT DOCUMENTS 4,102,513 A 7/1978 Guard
4,166,589 A 9/1979 Hoover et al.
4,535,951 A * 8/1985 Riemenschneider, III ..... B65B 67/085 242/588
4,872,623 A * 10/1989 Parry ..... B65B 67/085 242/588
5,203,517 A * 4/1993 Parry ..... B65B 67/085 242/422.4
5,597,135 A * 1/1997 Vandersteene ..... B65H 16/06 242/599.3
5,758,843 A * 6/1998 Ongaro ..... A47K 10/3836 242/563.2
6,227,480 B1 * 5/2001 Huang ..... B65H 75/185 242/588.2
6,651,918 B2 * 11/2003 Huang ..... B65H 75/185 242/588.2
6,892,975 B2 * 5/2005 Yu Chen ..... B65B 67/08 242/422.4
8,616,490 B2 12/2013 Blok
9,828,730 B2 * 11/2017 Melancon, Jr. ..... B32B 27/36
9,850,011 B2 12/2017 Nelson
10,683,124 B2 * 6/2020 Nelson ..... B65H 16/005
10,889,460 B2 * 1/2021 Ferguson ..... B65H 75/185
(Continued)

OTHER PUBLICATIONS

Youtube, Using ScotchBlue™ Pre-Taped Painters Plastic for Small Jobs and Touch-ups, https://www.youtube.com/watch?v=0nNr6MtvNaM, Jun. 17, 2015 (viewed Aug. 7, 2022).
(Continued)

*Primary Examiner* — William A. Rivera
(74) *Attorney, Agent, or Firm* — Kagan Binder, PLLC

(57) ABSTRACT

A core insert (103) for insertion into a core (700) of a roll (500, 600) of material and a hand tool using the core insert for applying the material to a surface (1100). The insert (103) includes a gripper sleeve bearing (7) rotatably connected to a spindle hub (101) attached to an axle shaft (1). The bearing (7) has tapered axial splines (104) extending away from center of the bearing (7) configured to grip the inner surface of the core (700). The hand tool includes the core insert (103) and an axle shaft (1), a handle shaft (2) and a shaft connector (9). The axle shaft (1) is insertable into the core (700) with the bearing (7) inserted into the (700) core to releasably and frictionally engage the core (700) so that the roll (500, 600) is rotatable about the axle shaft (1) along with the bearing (7).

13 Claims, 7 Drawing Sheets

(56) References Cited

U.S. PATENT DOCUMENTS

2006/0237577 A1* 10/2006 Chen ..... B65D 85/02
242/588

OTHER PUBLICATIONS

ScotchBlue Pre-taped Painter's Plastic with Dispenser, Unfolds to 48 inches by 30 yards,PTD2093EL-48, https://www.amazon.com/ScotchBlue-Pre-taped-Painters-Plastic-48-Inches/dp/B00AYB8T6W/ref=sr_1_5? (viewed Aug. 7, 2022) pp. 8.
Encore Packaging, LLC, EP-800 Pistol Grip, https://www.encorepack.com/ourproduct.php?sku=EP-800, (viewed Aug. 7, 2022) pp. 2.
Encore Packaging, LLC, EP-810 Pistol Grip with T-Handle, https://www.encorepack.com/ourproduct.php?sku=EP-810, (viewed Aug. 7, 2022) pp. 2.
Encore Packaging, LLC, EP-820 Ball Grip, https://www.encorepack.com/ourproduct.php?sku=EP-820, (viewed Aug. 7, 2022) pp. 2.
Deroulpack, https://www.deroulpack.fr/, (viewed Aug. 7, 2022) pp. 11.

* cited by examiner

CORE INSERT AND HAND TOOL FOR DISPENSING MATERIAL WOUND ON A CORE

FIELD OF THE INVENTION

The present invention relates generally to dispensers configured to dispense a roll of material wound on a core.

BACKGROUND OF THE INVENTION

Many materials are wound onto plastic and paper cores, such as tape and plastic film. Such materials include plastic masking film, and pre-taped masking film where masking tape is attached to one side of a sheet of plastic masking film where the combined product (pre-taped masking film) is wound onto a core to form a roll of the pre-taped masking film. An example of such material is PlazMask™ Pre-Taped Masking Film. Such material employs masking tape, e.g. 0.75 inch (19.05 mm) wide masking tape, continuously attached to one side of an extended sheet of plastic masking film, which film may be, for example 2 feet (0.61 m), 4 feet (1.22 m) or 12 feet (3.66 m) wide. The masking film is typically folded before being wound onto a core so that, for example, 0.75 inch (19.05 mm) wide masking tape attached to pre-folded 12 foot (3.66 m) plastic masking film can be wound onto a core to produce a roll of pre-taped masking film that is only 10 inches (254 mm) long.

The resulting masking product is employed for temporary adhesive application to a surface for the purpose of protecting the covered surface from paint overspray or other materials, such as paint, stucco, epoxy or other coating-type products, to be applied to the adjacent surface, such as a plaster wall or drywall. The masking tape and film combination can also be used for protection from ultraviolet light or contaminants like dust and dirt. Such material may be applied to surfaces of things such as, automobiles, boats, interior and exterior walls, ceilings, floors, windows, baseboards, cabinets, furniture, etc.

Dispensing such material by hand can be challenging because of the need to unfold the film. Dispensers exist that provide a serrated cutter blade, similar in function to a desktop adhesive tape dispenser. However, these require the user to cut off a piece of pre-taped masking film, which may be quite long, and then apply the masking tape to the surface and unfold the film.

It would be desirable to provide a dispenser that allows a user to continuously dispense such material as the masking tape is being applied to a surface.

SUMMARY OF THE INVENTION

The invention provides a core insert for insertion into a hollow cylindrical core. The core insert includes a gripper sleeve bearing rotatably connected to and retained on a spindle hub by a retaining mechanism. The spindle hub is a hollow cylindrical shaft tube having a constant inner diameter and a constant outer diameter, rigidly attached to a hollow cylindrical spindle base. The spindle base has an inner diameter equal to the inner diameter of the shaft tube and an outer diameter greater than the outer diameter of the shaft tube.

The gripper sleeve bearing is a hollow cylindrical sleeve tube with multiple external axial splines aligned with the longitudinal axis of the spindle hub and gripper sleeve bearing. The splines extend away from the longitudinal axis by a varying distance from the outer surface of the sleeve tube. The gripper sleeve bearing has a length less than the length of the shaft tube, and a constant inner diameter greater than the outer diameter of the shaft tube and less than the outer diameter of the spindle base. Each spline is tapered so that towards the proximal end of the gripper sleeve bearing the spline extends from the longitudinal axis by a distance greater than half of the inner diameter of the core and towards the distal end of the gripper sleeve bearing the spline extends from the longitudinal axis by a distance less than half of the inner diameter of the core.

The shaft tube is inserted into the gripper sleeve bearing so that the longitudinal axis of the gripper sleeve bearing is coincident with the longitudinal axis of the shaft tube, and the proximal end of the gripper sleeve bearing is proximate to the spindle base. The gripper sleeve bearing is rotatable about the shaft tube. The retaining mechanism is configured to retain the gripper sleeve bearing in rotational engagement with the shaft tube.

The retaining mechanism is preferably a metal ring having an inner diameter less than the outer diameter of the shaft tube and an outer diameter greater than the inner diameter of the gripper sleeve bearing, so that the metal ring is frictionally engaged around the distal end of the shaft tube proximate to the distal end of the gripper sleeve bearing.

The metal ring may be disposed in a circular retaining ring groove surrounding the longitudinal axis in the outer surface of the sleeve tube proximate to the distal end of the gripper sleeve bearing. The retaining ring groove is spaced apart from the spindle base by a distance at least as great as the length of the gripper sleeve bearing so that the gripper sleeve bearing is disposed between the metal ring and the spindle base, which constrain movement of the gripper sleeve bearing relative to the longitudinal axis.

The splines are preferably regularly radially spaced about the outer surface of the sleeve tube. There may be exactly eight splines.

The spindle base may include a set screw to facilitate rigidly attaching the spindle hub to a cylindrical axle shaft having a longitudinal axis coincident with the longitudinal axis of the spindle hub and inserted in the core insert, and to facilitate changing the axial position of the core insert relative to the cylindrical axle shaft.

The spindle hub is preferably integrally formed from metal. The spindle hub may be machined from aluminum.

The gripper sleeve bearing is preferably integrally formed from plastic.

The invention further provides a hand tool for applying material to a surface. The material is wound onto a hollow cylindrical core to form a roll. The hand tool includes the core insert described above in addition to a cylindrical axle shaft, an elongated handle shaft and a shaft connector with the distal end of the shaft connector being rigidly connected to the proximal end of the handle shaft and the proximal end of the shaft connector being rigidly connected to the proximal end of the axle shaft.

The cylindrical axle shaft has an outer diameter less than the inner diameter of the core and less than the inner diameter of the shaft tube. The axle shaft is inserted into the shaft tube and the spindle hub is rigidly attached to the axle shaft.

The handle shaft is spaced apart from the axle shaft by more than half of the outer diameter of the roll and has a longitudinal axis approximately parallel to longitudinal axis of the axle shaft.

The axle shaft is insertable into the core of the roll with the longitudinal axes of the roll and axle shaft being approximately coincident, and with the gripper sleeve bearing inserted into the core sufficiently far to releasably and frictionally engage the core so that the roll is rotatable about the axle shaft and shaft tube along with the gripper sleeve bearing.

The hand tool preferably also includes a cylindrical guide knob rigidly attached to the distal end of the axle shaft. The guide knob has a maximum diameter less than the inner diameter of the core. The ends of the guide knob are tapered to a diameter less than the maximum diameter of the guide knob towards the proximal and distal ends of the guide knob. The maximum diameter of the guide knob is sufficiently close to the inner diameter of the core to constrain lateral movement of the core and the roll when the axle shaft is inserted into the core so as to maintain approximate coincidence of the longitudinal axes of the roll and the axle shaft.

The proximal end of the shaft connector is preferably tubular with an outer diameter equal to the outer diameter of the axle shaft.

The guide knob may have internal threading for removable attachment to corresponding threading on the distal end of the axle shaft.

The length of the axle shaft is preferably selected so that when the axle shaft is inserted into the core with the gripper sleeve bearing frictionally engaged with the proximal end of the core, no portion of the axle shaft or guide knob protrudes from the distal end of the core.

The length of the handle shaft is preferably approximately equal to the length of the axle shaft.

The axle shaft, shaft connector and handle shaft may be integrally formed in a U shape.

The axle shaft, shaft connector and handle shaft comprise a lightweight metal tube. The metal may be aluminum.

The hand tool preferably also includes a grip attached to the handle shaft encircling a portion of the handle shaft and configured to facilitate a user holding the hand tool by the grip. The grip may be movable along the longitudinal axis of the handle shaft.

The material may be pre-taped masking film.

The invention also provides a second set of embodiments of a hand tool for applying material to a surface, the material being wound onto a hollow cylindrical core to form a roll. The second set of embodiments includes a U-shaped tube, a cylindrical spindle hub, and a cylindrical gripper sleeve bearing. The U-shaped tube has straight first and second legs, the first leg being parallel to the second leg, and a curved connecting portion extending between the first and second legs. The guide knob is rigidly attached to an end of the first leg and has a diameter approximately equal to and not greater than the inner diameter of the core. The spindle hub is rigidly attached to the first leg and spaced apart from the guide knob. The gripper sleeve bearing is rotatably connected to the spindle hub. The gripper sleeve bearing has a varying diameter that increases from a distal diameter that is less than the inner diameter of the core at an end nearest to the guide knob to a proximal diameter that is greater than the inner diameter of the core at an end furthest to the guide knob. The first leg is insertable into the core so that the gripper sleeve bearing is partially inserted into the proximal end of the core and frictionally engages the core so that the roll is rotatable about the axle shaft with the gripper sleeve bearing.

The second set of embodiments preferably also include a grip attached to the second leg encircling a portion of the second leg, where the grip is configured to facilitate a user holding the hand tool by the grip.

The guide knob of the second set of embodiments is spaced apart from the gripper sleeve bearing so that when the first leg is inserted into the core with the gripper sleeve bearing frictionally engaged with the core, no portion of the first leg or guide knob protrudes out of the distal end of the core.

It should be noted that some, but not all, embodiments of the first set of embodiments of the hand tool described above and the second set of embodiments coincide.

DESCRIPTION OF THE INVENTION

Figure 1A:
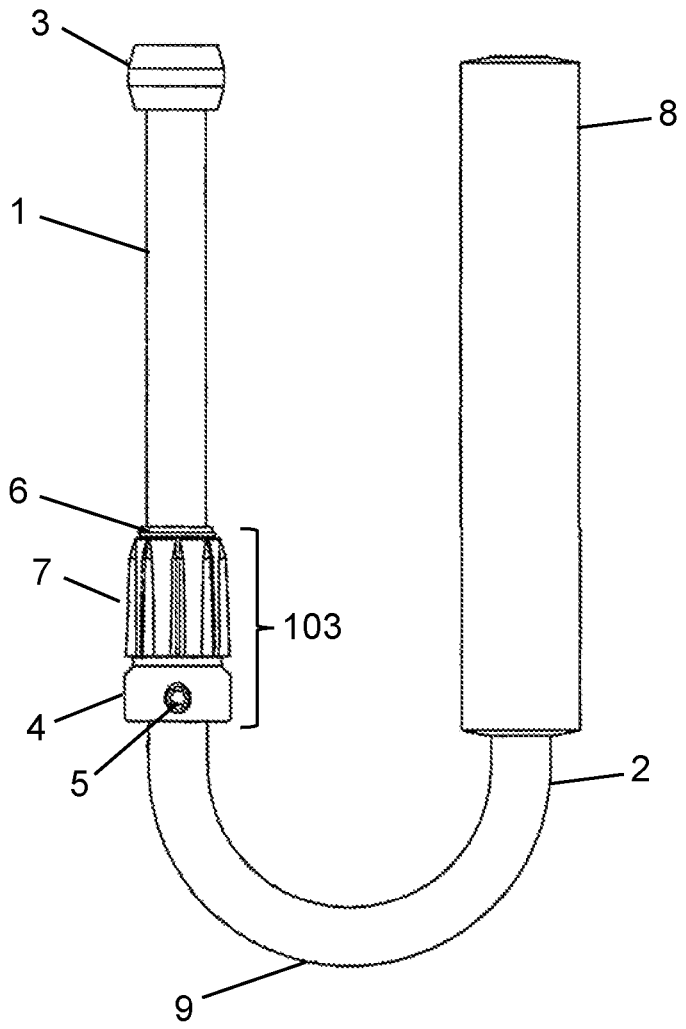
FIG. 1A is a side view of an embodiment of a hand tool for applying material to a surface, the material being wound onto a hollow cylindrical core to form a roll.

The present invention is hand tool for dispensing flexible material wound onto a core 700 employing an innovative core insert 103. The flexible material may be, for example, pre-taped masking film 1101 that is wound on a core 700 to form a roll 500, 600, where masking tape 502 is attached to one side of a sheet of plastic masking film 501, 601. The masking film is typically folded before (or while) being wound onto a core to reduce the length of the roll 500, 600. The masking film may be 0.5 mil (0.0127 mm) thick protective film with integrated static cling. Such pre-taped masking film 1101 is used, for example, for general purpose automotive applications, equipment coverage, and paint protection.

Figure 11:
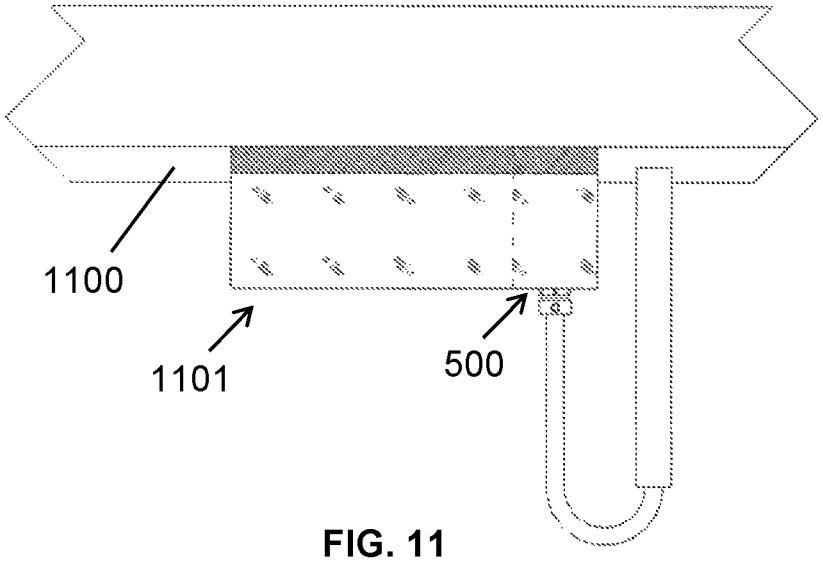
FIG. 11 shows an embodiment of a hand tool with an attached roll of material being applied to a surface.

Such cores 700 are hollow cylinders with relatively thin walls and typically are made from paper/cardboard or plastic. Such cores 700 are generally deformable to an extent. Deformation, which may occur during shipping or during use, results in some variation of the inner diameter of the core 700 so that at some points the inner diameter is greater or less than the original inner diameter of the core 700, which is generally referred to herein as the inner diameter of the core 700. The length of the core 700 is selected to be approximately equal to the (folded, as applicable) width of the material wound onto the core 700. In some cases, portions of the wound material may extend slightly beyond one or both ends of the core 700.

Where the material is pre-taped masking film 1101 (see FIG. 11), the user typically either unrolls and cuts off a portion of the material before unfolding the film and attaching the masking tape 502 to a surface 1100, or the user attaches the masking 502 to a surface 1100 as the user unrolls and, optionally, unfolds the material. Particularly for attaching the material to a relatively long surface, the latter approach may be more effective and more efficient. However, this is difficult to perform efficiently by simply holding and rotating the roll in one's hand. The present invention is a hand tool that allows the user to easily unroll the material while holding the handle of the tool in one hand, e.g. the right hand. In order to do this, the roll 500, 600 must rotate as the user moves his or her right hand laterally, thereby unrolling the material, while the user uses his or her left hand to attach the masking tape 502 to the surface 1100, and, optionally, periodically unfolds the film. Normally the film will only be unfolded after the masking tape 502 has been attached to the entire desired portion of the surface 1100.

Figure 1B:
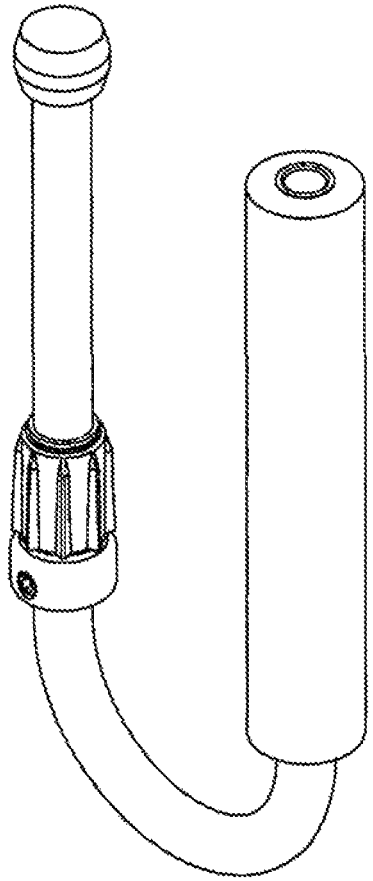
FIG. 1B is a perspective view of the hand tool of FIG. 1A.
Figure 2A:
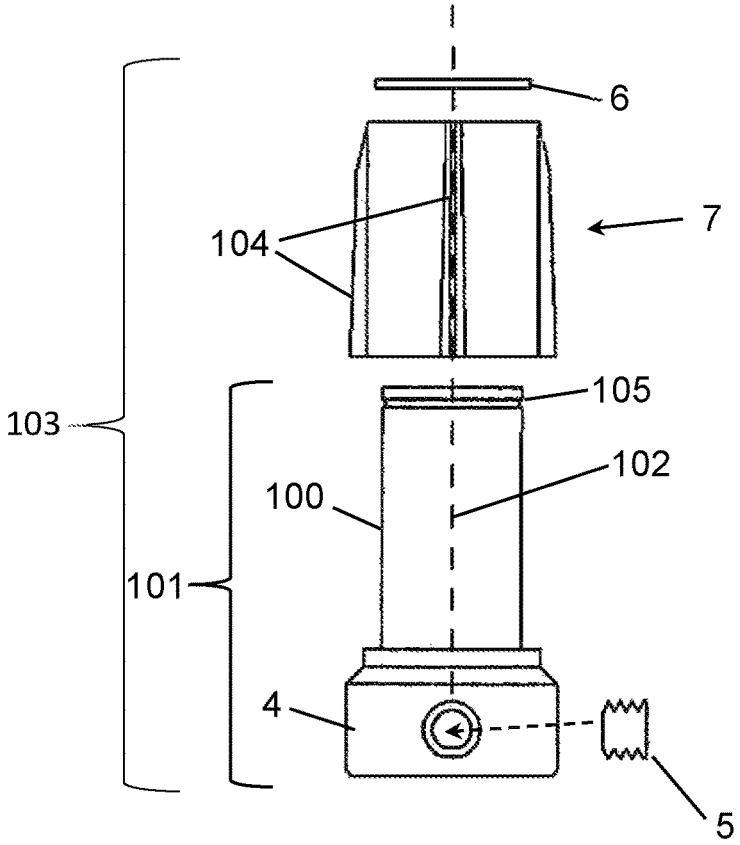
FIG. 2A is an exploded side view of the core insert used in the hand tool of FIG. 1A.
Figure 7:
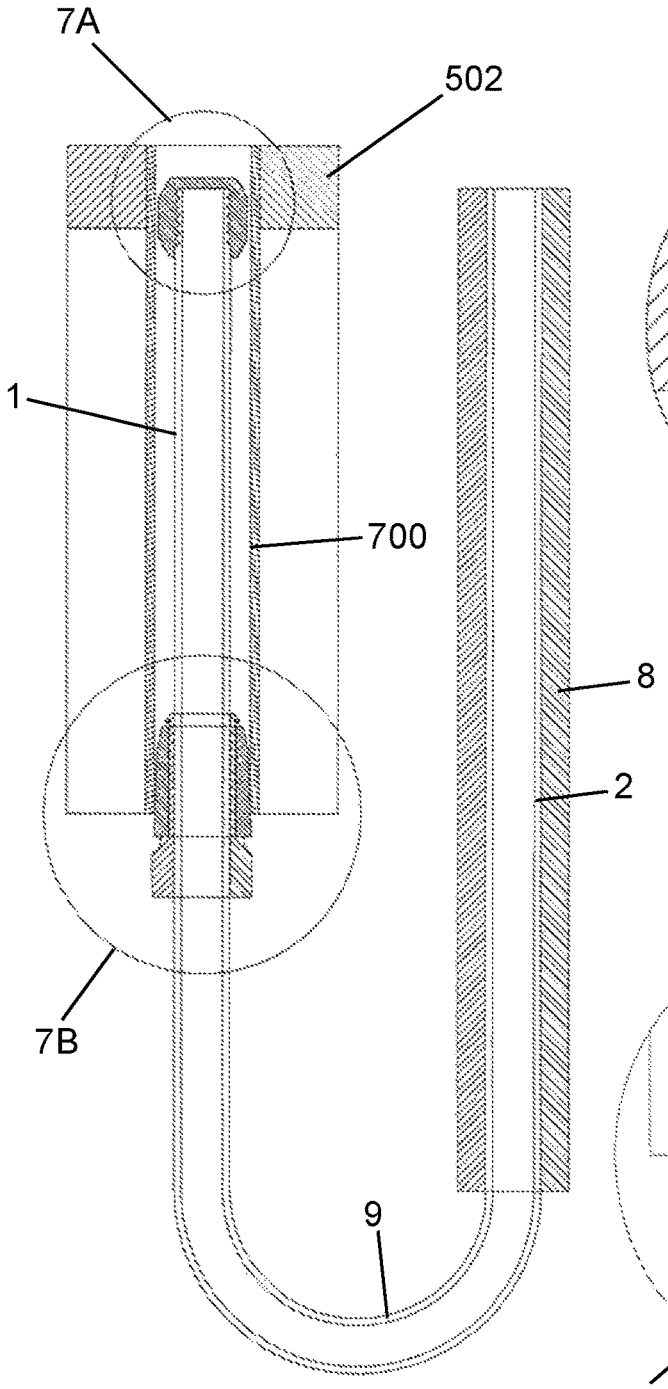
FIG. 7 is a cross-sectional side view of an embodiment of a hand tool for applying material to a surface, the material being wound onto a hollow cylindrical core to form a roll, with a roll of material attached to the axle shaft of the hand tool showing the frictional engagement of the gripper sleeve bearing with the inner surface of the core.

In order to facilitate such use, the hand tool employs an innovative core insert 103, as depicted in FIGS. 1, 2 and 7. The core insert 103 has two components, a spindle hub 101 and a gripper sleeve bearing 7 that rotates about the shaft tube 100 of the spindle hub 101. The spindle hub 101 is preferably made of metal, preferably being machined from aluminum, although it could be made from other materials, such as plastic. For descriptive purposes, the spindle hub 101 can be divided into a shaft tube 100 and spindle base 4, where the shaft tube 100 is a hollow cylinder with a longitudinal axis 102 (i.e. a vertical axis in FIG. 2). The spindle base 4 is also a hollow cylinder but has a greater outer diameter than the shaft tube 100, and may have a variable, or stepped, outer diameter. The distal end of the spindle base 4 (the top end of the spindle base 4 in FIG. 2A) is rigidly attached to the proximal end of the shaft tube 100 (the lower end of the shaft tube 100 in FIG. 2A). Preferably the spindle base 4 and the shaft tube 100 are integrally formed by machining the spindle hub 101 from aluminum. References to the outer diameter of the spindle base 4 are meant to refer to the maximum outer diameter unless otherwise specified. The maximum outer diameter, and also preferably the minimum outer diameter, of the spindle base 4 are selected to be greater than the inner diameter of the gripper sleeve bearing 7.

Although it is not preferred, the outer surface of the cylindrical spindle base 4 may not be cylindrical, and may, for example, be oval, square, hexagonal, etc.

The shaft tube 100 and spindle base 4 preferably have the same inner diameter so that the spindle hub 101 has a cylindrical bore with a constant diameter, which is the inner diameter of the spindle hub 101. As noted, the spindle hub 101 is preferably machined from aluminum and so is preferably a single rigid piece, although embodiments are possible where the spindle hub 101 is formed by rigidly attaching two or more separate elements together.

Figure 5:
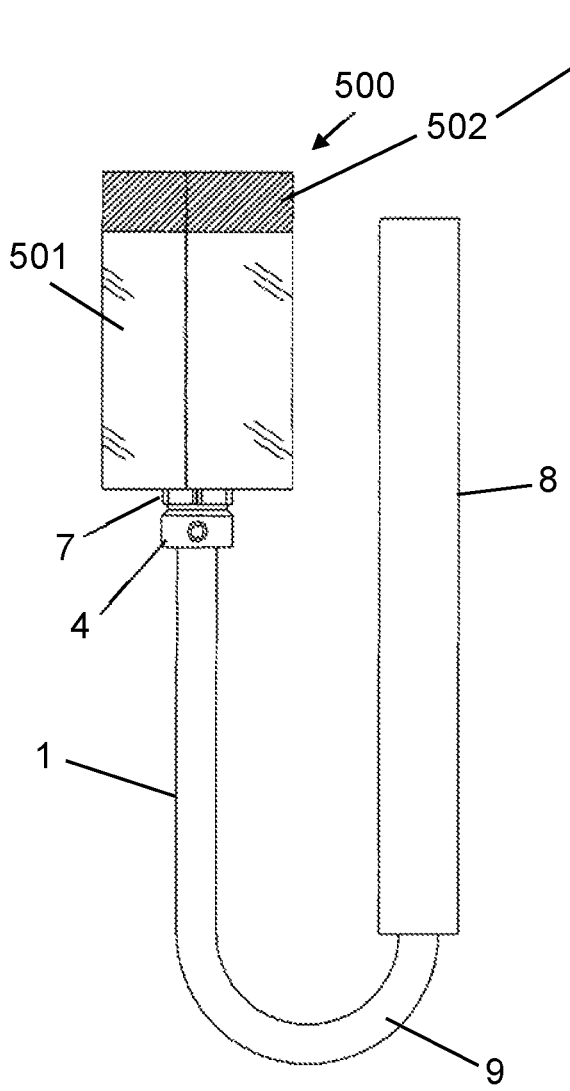
FIG. 5 is a side view of an embodiment of a hand tool for applying material to a surface, the material being wound onto a hollow cylindrical core to form a roll, with the axle shaft of the hand tool inserted into a roll of material.
Figure 6:
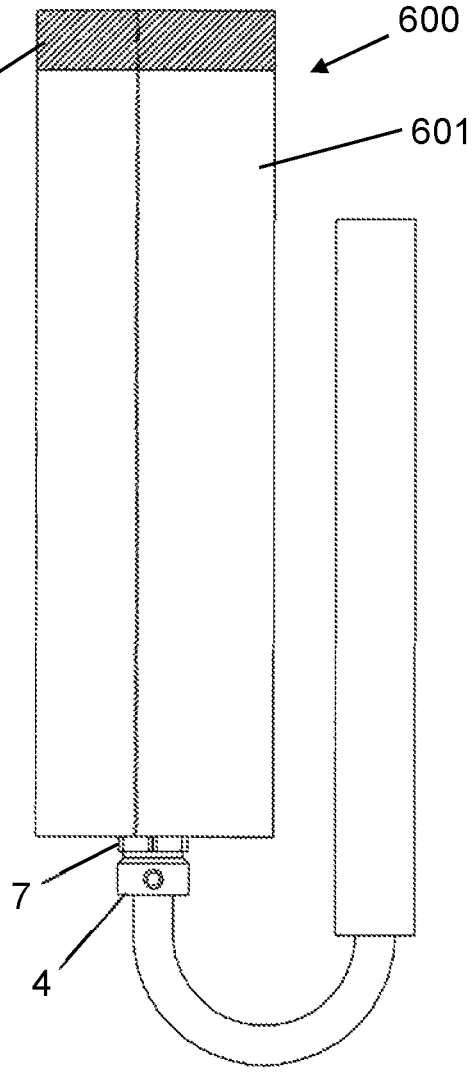
FIG. 6 is a side view of an embodiment of a hand tool for applying material to a surface, the material being wound onto a hollow cylindrical core to form a roll, with the axle shaft of the hand tool inserted into a longer roll of material.

The spindle hub 101 also preferably includes a set screw 5 that can be inserted into the spindle base 4 through a threaded lateral (i.e. perpendicular to the longitudinal axis 102) bore in the spindle base 4 so as to rigidly secure the spindle hub 101 to a shaft inserted though the bore of the spindle hub 101. By rotating the set screw 5, the set screw 5 can be rotated to firmly contact the outer surface of the shaft and maintain the spindle hub 101 in a fixed position relative to the shaft. The set screw 5 may be, for example, a hex socket set screw that can be inserted into the threaded bore by using, for example, a 0.125 inch (3.175 mm) hex key (also known as an Allen wrench). By rotating the set screw 5 in the opposite direction, the spindle hub 101 can be detached from the shaft, for example in order to reposition the spindle hub 101 longitudinally (i.e. vertically in FIG. 1A) on the shaft. See, for example, FIG. 5, where the spindle hub 101 has been moved up the axle shaft 1 as compared to the spindle hub 101 depicted in FIG. 6 in order to better accommodate a roll 500 with a relatively short length.

The spindle hub 101 also preferably includes a retaining ring groove 105 near the distal end of the shaft tube 100 (the upper portion of the shaft tube 100 in FIG. 2A) configured to receive a metal ring 6. This provides a preferred retaining mechanism for retaining the gripper sleeve bearing 7 on the spindle hub 101. The depth of the retaining ring groove 105 and the inner diameter of the metal ring 6 are selected so that the metal ring 6 fits in the retaining ring groove 105, but the retaining ring groove 105 is relatively shallow in order to facilitate placement of the metal ring 6 in the retaining ring groove 105 during manufacturing. That is, the inner diameter of the metal ring 6 is selected to be slightly less than the outer diameter of the shaft tube 100 above and below the retaining ring groove 105 so that the metal ring 6 is retained on the shaft tube 100. The metal ring 6 has an outer diameter greater than the inner diameter of the gripper sleeve bearing 7 so that the gripper sleeve bearing 7, when disposed on the shaft tube 100, as in FIG. 2B, has very limited longitudinal mobility, being constrained at its proximal end by the spindle base 4 because of the larger outer diameter of the spindle base 4 relative to the inner diameter of the gripper sleeve bearing 7 and at the distal end by metal ring 6 because of the larger outer diameter of the metal ring 6 relative to the inner diameter of the gripper sleeve bearing 7.

Various alternate retaining mechanisms are possible, such as having one or more retractable nubs (also referred to as detents) inserted into a bore hole in the shaft tube 100 near the distal end of the shaft tube 100 that can be temporarily pushed into the bore hole while the gripper sleeve bearing 7 is being attached to the shaft tube 100, and which are biased so as to, on removal of force from the nub(s), extend beyond the outer surface of the shaft tube 100, to more than twice the lateral distance from the longitudinal axis 102 to the inner surface of the gripper sleeve bearing 7 (i.e. more than half the inner diameter of the gripper sleeve bearing 7). In some embodiments, the retaining mechanism may be machined into the distal end of shaft tube 100. For example, rather than having a retaining ring groove 105 in the shaft tube 100, the top-most portion of the shaft tube 100 might have a slightly greater outer diameter that the inner diameter of the gripper sleeve bearing 7. This is not preferred though as it may be difficult to attach the gripper sleeve bearing 7 to the spindle hub 101 and it would require a certain degree of deformability of the material used to form the gripper sleeve bearing 7 or, for example, require that the gripper sleeve bearing 7 to consist of two portions (e.g. each covering 180 degrees about the longitudinal axis 102) that are assembled onto the shaft tube 100.

Figure 8:
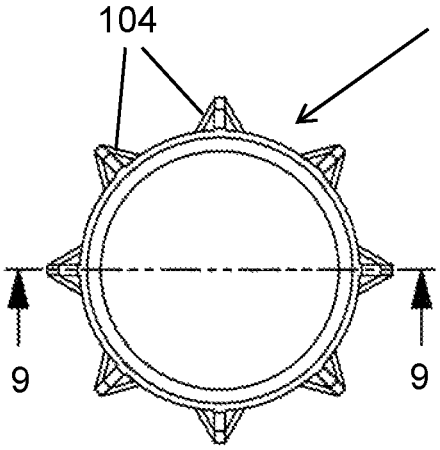
FIG. 8 is a top view of a gripper sleeve bearing having eight splines.
Figure 9:
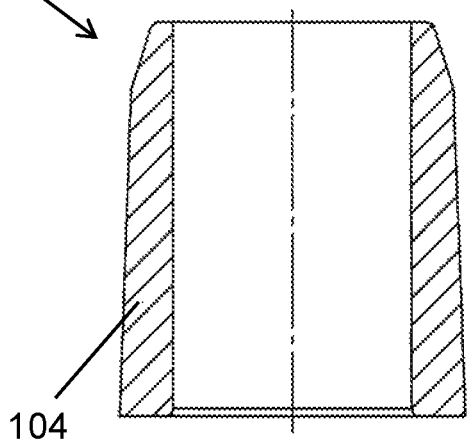
FIG. 9 is a side sectional view through the line 9-9 in FIG. 8.
Figure 10A:
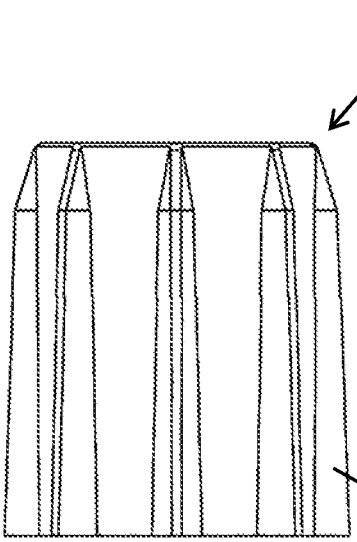
FIG. 10A is a side view of the gripper sleeve bearing of FIG. 8.
Figure 10B:
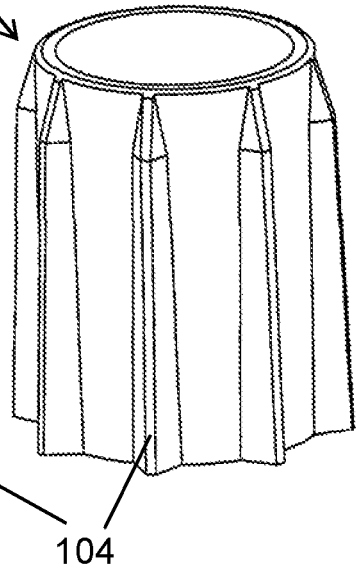
FIG. 10B is a perspective view of the gripper sleeve bearing of FIG. 8.

A preferred embodiment of the gripper sleeve bearing 7 is depicted in isolation in FIGS. 8-10. The gripper sleeve bearing 7 is preferably integrally formed from plastic, but for descriptive purposes can be considered to consist of a sleeve tube and multiple external axial splines 104. The gripper sleeve bearing 7 could alternately be made from other materials, such as metal. The sleeve tube is preferably cylindrical with constant inner and outer diameters, but may have a slightly varying outer diameter, which could increase (e.g. continuously or linearly) from the distal end (i.e. the upper end in FIG. 10A) to the proximal end (i.e. the upper end in FIG. 10A). The outer diameter of the sleeve tube at and near the distal end of the gripper sleeve bearing 7 is strictly less than the inner diameter of the core 700. The inner diameter of the gripper sleeve bearing 7 is preferably constant and must be greater than, but preferably very close to, the outer diameter of the shaft tube 100. For example, the constant inner diameter of the gripper sleeve bearing 7 may be 0.5-2% greater than the constant outer diameter of the shaft tube 100.

Figure 2B:
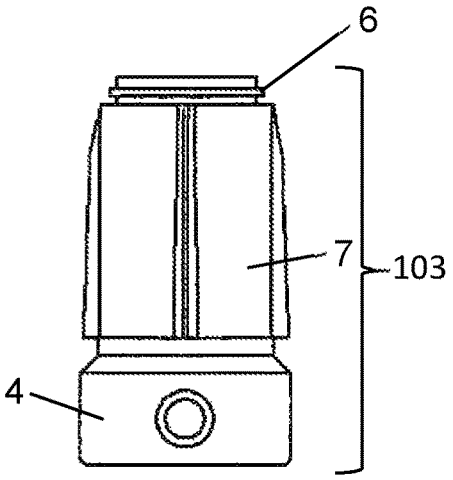
FIG. 2B is a side view of the core insert used in the hand tool of FIG. 1A.

The splines 104 extend longitudinally (i.e. axially) along the outer surface of the sleeve tube parallel to the longitudinal axis of the gripper sleeve bearing 7, which is coincident with the longitudinal axis 102 of the shaft tube 100 when the gripper sleeve bearing 7 is disposed on the shaft tube 100, as in FIG. 2B. The splines 104 are preferably regularly radially spaced about the outer surface of the sleeve tube. The number of splines 104 preferably ranges from 4 to 12, and most preferably there are 8 regularly spaced splines 104 as shown in FIGS. 8-10. The splines 104 are preferably relatively narrow. For example, each spline 104 may cover, at its base which is attached to the outer surface of the sleeve tube, less than 30 degrees about the longitudinal axis, and preferably less than 15 degrees. Each spline 104 preferably is tapered so that narrows laterally as it extends away from the longitudinal axis (e.g. so that it has a near triangular cross-section), for example as shown in FIG. 8, so that the outer end of each spline 104 covers less than 5 degrees, and preferably less than 2 degrees, about the longitudinal axis so that the outermost portion of each spline 104 is a narrow surface extending parallel to the longitudinal axis on an angle relative to the axis that increases from the distal end of the gripper sleeve bearing 7 to the proximal end of the gripper sleeve bearing 7.

At the distal end, the outer surface of each spline 104 is spaced apart from the longitudinal axis by less than half of the inner diameter of the core 700, and at the proximal end the outer surface of each spline 104 is spaced apart from the longitudinal axis by more than half of the inner diameter of the core 700. The spacing of the outer surfaces of the splines 104 from the longitudinal axis increases continuously from the distal end to the proximal end. The variation of the spacing need not be linear, but preferably is at least is monotonically non-decreasing, which herein may be referred to as the splines 104 being tapered. For example, as can be seen in FIG. 10, the rate of increase of the spacing may be greater over a portion of the longitudinal axis nearest the distal end. This may be useful to make it easier for a user to insert the gripper sleeve bearing 7 into the core 700 as the alignment of the longitudinal axes of the gripper sleeve bearing 7 and the core 700 can then be less precise when the gripper sleeve bearing 7 initially enters the core 700. As the user applies force to push the gripper sleeve bearing 7 further into the core 700 the increasing spacing of the outer surfaces of the splines 104 from the longitudinal axis forces the axes of the longitudinal axes of the gripper sleeve bearing 7 and the core 700 to align/coincide at the point shown in FIG. 7B that the core insert 103 resists being inserted further in to the core 700 without damaging the core. At this point, a firm frictional engagement of the core insert 103, i.e. portions of the narrow outer surfaces of the splines 104, with the inner surface of the core 700 is established so that when the roll 500, 600 is rotated by pulling material away from/off the roll 500, 600, it causes the gripper sleeve bearing 7 to rotate about the shaft tube 100 so that the roll 500, 600 and gripper sleeve bearing 7B together rotate about a portion of the axle shaft 1 and an upper portion of the shaft tube 100, and the roll 500, 600 rotates about the axle shaft 1, metal ring 6 and the guide knob 3, the spindle hub 101 and guide knob 3 being rigidly connected to the axle shaft 1, which in turn is rigidly connected to the shaft connector 9 and handle shaft 2.

The use of splines 104 that vary in distance from the longitudinal axis is particularly useful when inserting the gripper sleeve bearing 7 into a deformed core 700 where it would be difficult to align and insert an element with an outer diameter about equal to that of the inner diameter of the core 700. The splines also facilitate a stronger frictional engagement with the core 700 than could be achieved by an element with a constant outer diameter equal to the inner diameter of the core 700. The reason for this is that such cores 700 are deformable and when the gripper sleeve bearing 7 is forced sufficiently far into the core 700, in the position shown in FIG. 7B, useful deformation of the core 700 occurs. For example, when using a gripper sleeve bearing 7 with 8 splines, the inner surface of the core 700 at the proximal end will deform slightly to approach a shape with an octagonal lateral cross-section. At this point, the outer surfaces of the splines 104 nearest the proximal end of the gripper sleeve bearing 7 that are in contact with the inner surface of the core 700 will actually be slightly further than half of the diameter of the non-deformed core 700 from the longitudinal axis.

In some embodiments, which are not preferred, the gripper sleeve bearing 7 may not incorporate external axial splines 104, but may just rely on the outer diameter of the sleeve tube increasing continuously, or at least being monotonically non-decreasing, possibly linearly or stepwise linearly, from less than the inner diameter of the core 700 at the distal end of the sleeve tube to greater than the inner diameter of the core 700 at the proximal end of the sleeve tube.

The hand tool includes an axle shaft 1 connected to a shaft connector 9 that is in turn connected to a handle shaft 2. An embodiment of the hand tool using the core insert 103 is depicted in FIGS. 1A and 1B by itself, and in FIGS. 5-7, 11 and 12 with a roll 500, 600 of material attached to the tool. The depicted material is plastic masking film 501, 601 with attached masking tape 502. However, the hand tool could be used with any material wound on a core 700.

The axle shaft 1 is cylindrical with an outer diameter less than, but preferably very close to, the inner diameter of the spindle hub 101 so that the axle shaft 1 can be inserted into and through the bore of the spindle hub 101. The axle shaft 1 preferably has a length greater than the length of the length of the roll 500, 600. The spindle hub 101 is preferably attached to the axle shaft 1, for example by tightening a set screw 5 in the spindle base 4, so that the distance, which is referred to herein as "D", between the distal end (i.e. upper end in FIG. 2A) of the spindle base 4 and the distal end (i.e. the upper end in FIG. 1A) of the guide knob 3 is less than the length of the roll 500, 600, or at least not greater than the length of the roll 500, 600 by an amount approximately equal to the longitudinal distance from the proximal end of the gripper sleeve bearing 7 to the point nearest the proximal end of the gripper sleeve bearing 7 where the splines 104 contact the inner surface of the core 700. The distance D can be adjusted by longitudinally moving the spindle hub 101 along the axle shaft 1, for example by detaching the spindle hub 101 by counter-clockwise rotation of the set screw 5, sliding the spindle hub 101 along the axle shaft 1, and then re-attaching the spindle hub 101 at the new position along the axle shaft 1 by clockwise rotation of the set screw 5 until the set screw 5 abuts the outer surface of the axle shaft 1 sufficiently firmly to retain the spindle hub 101 in that position relative to the axle shaft 1.

The axle shaft 1 is preferably a hollow tube formed from a lightweight material, such as aluminum. It is not essential that the axle shaft 1 be a hollow tube, but this is preferred to minimize the weight. It could be, for example, a solid plastic cylinder, but this is not preferred.

Figure 3:
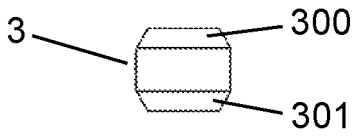
FIG. 3 is a side view of the guide knob used in the hand tool of FIG. 1A.
Figure 7A:
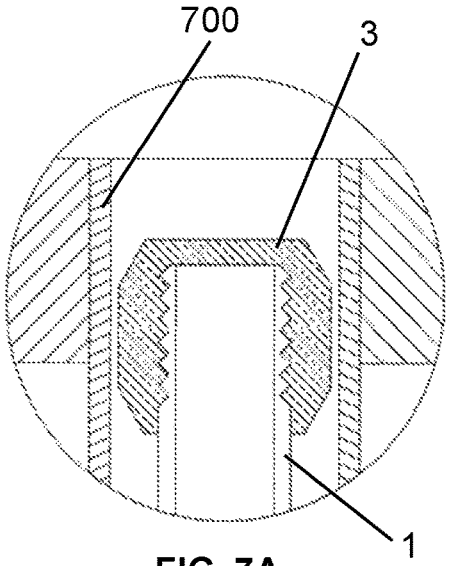
FIG. 7A is an enlarged view of a portion of FIG. 7 showing the guide knob adjacent to and abutting the inner surface of the core.
Figure 7B:
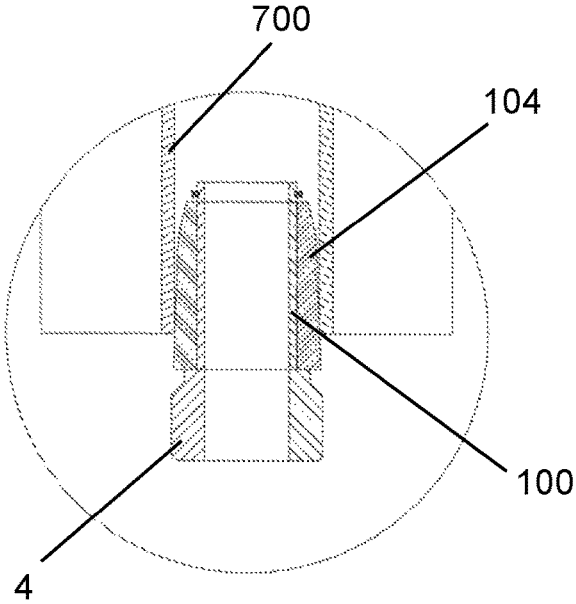
FIG. 7B is an enlarged view of a portion of FIG. 7 showing the frictional engagement of the gripper sleeve bearing with the inner surface of the core.

It is preferred that the hand tool also include a guide knob 3 with interior threading configured to mate with guide knob threading 400 near the distal end (i.e. the upper end in FIGS. 1A and 4) of the axle shaft 1, so that the guide knob 3 is rigidly attached to the distal end of the axle shaft 1. Other methods of rigidly attaching the guide knob 3 to the axle shaft 1 may alternately be used. The guide knob 3 has a proximal end (the lower end in FIG. 3) and a distal end (the upper end in FIG. 3) and a maximum diameter less than the inner diameter of the core 700, but preferably close enough to the diameter of the core 700 in order to reasonably constrain lateral movement of the core 700 and the roll 500, 600 when the axle shaft 1 with the attached guide knob 3 is inserted into the core 700 as shown in FIG. 7A so as to maintain approximate coincidence of the longitudinal axes of the roll 500, 600 and the axle shaft 1. For example, the maximum diameter of the guide knob 3 may be 1-3% less than the inner diameter of the core 700. The relatively close fit of the guide knob 3 in the core 700 can be seen in FIG. 7A. However, it is important that the guide knob 3 have a strictly smaller diameter than the inner diameter of the core 700 so the guide knob 3 does not inhibit rotation of the core 700 about the guide knob 3. The ends of the guide knob 3 may have a proximal portion 301 and a distal portion 300 (see FIG. 3) that are tapered to a diameter less than the maximum diameter of the guide knob 3 towards the proximal and distal ends of the guide knob 3 respectively to facilitate easy insertion of the axle shaft 1 with the attached guide knob 3 into the core 700. The guide knob 3 is preferably made of plastic, but could be made from other materials, such as wood or metal.

The handle shaft 2 is a shaft that can be used as a handle by a user. It is preferred that the handle shaft 2 be straight. The handle shaft 2 is rigidly attached to the axle shaft 1 by the shaft connector 9 so that the longitudinal axes of the axle shaft 1 and the handle shaft 2 are approximately parallel. It is also preferred that the length of the handle shaft 2 be approximately equal to the length of the axle shaft 1 so that the distal ends of the axle shaft 1 and the handle shaft 2 are at approximately the same longitudinal position. This is not essential but may be helpful to permit a user to grip the handle shaft 2 or a grip 8 on the handle shaft 2 in a balanced manner when roll 500, 600 is attached to the axle shaft 1. The outer surface of the handle shaft 1 is spaced apart from the longitudinal axis of the axle shaft 1 sufficiently far (which is more than half the outer diameter of the roll 500, 600) so that a user can easily grip the handle shaft 2, or a grip 8 attached to the handle shaft 2, using one hand when a roll 500, 600 of material is on the axle shaft 1.

Figure 12:
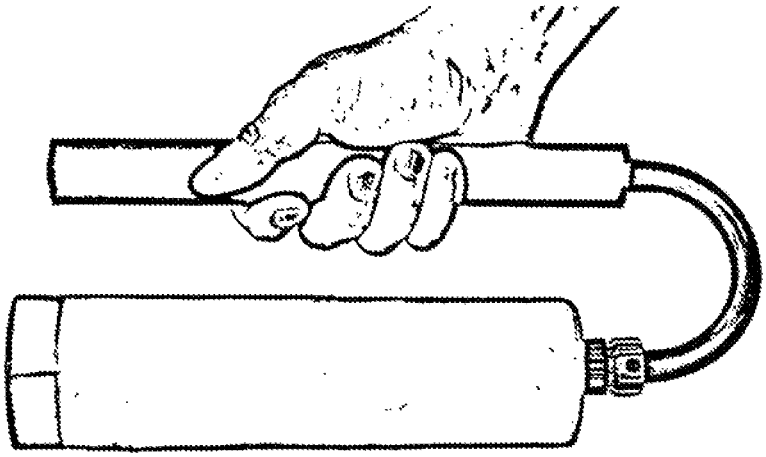
FIG. 12 is a side view of a user's hand holding the grip of a hand tool with an attached roll of material.

In preferred embodiments, the handle shaft 2 is a hollow aluminum tube, like the axle shaft 1, and the hand tool further includes a grip 8 attached to the axle shaft 1 as shown in FIG. 1, that can be gripped by a user with one hand as depicted in FIG. 12. The grip 8 may be a hollow tube made of a sturdy foam material that can be slid over the handle shaft 2 and maintained in place, for example, by adhesive or by frictional engagement with the outer surface of the handle shaft 2. The grip 8, when frictionally engaged with the handle shaft 2, may be longitudinally slidable so that a user can adjust the longitudinal position of the grip 8 by applying sufficient longitudinal force to the grip 8 relative to the handle shaft 2 to temporarily overcome the frictional engagement of the grip 8 and handle shaft 2.

The shaft connector 9 rigidly connects the axle shaft 1 to the handle shaft 2 so that they are maintained with their longitudinal axes aligned (i.e. approximately parallel). A preferred embodiment of the shaft connector 9 is a curved hollow aluminum tube where the axle shaft 1, shaft connector 9, and handle shaft 2 are a single integrally formed hollow U-shaped aluminum tube, as depicted, for example, in FIG. 4. It is preferred that each of the axle shaft 1, shaft connector 9, and handle shaft 2 have the same inner and outer diameter. Many other embodiments of the shaft connector 9 are of course possible such as a straight metal piece that attaches to the proximal ends of both the axle shaft 1 and handle shaft 2. However, an integrated hollow U-shaped aluminum tube is preferred for ease of manufacturing and for being strong but light. In other embodiments one, two or all of the axle shaft 1, shaft connector 9, and handle shaft 2 may be made of different materials, such as plastic or wood, and may not be hollow.

Figure 4:
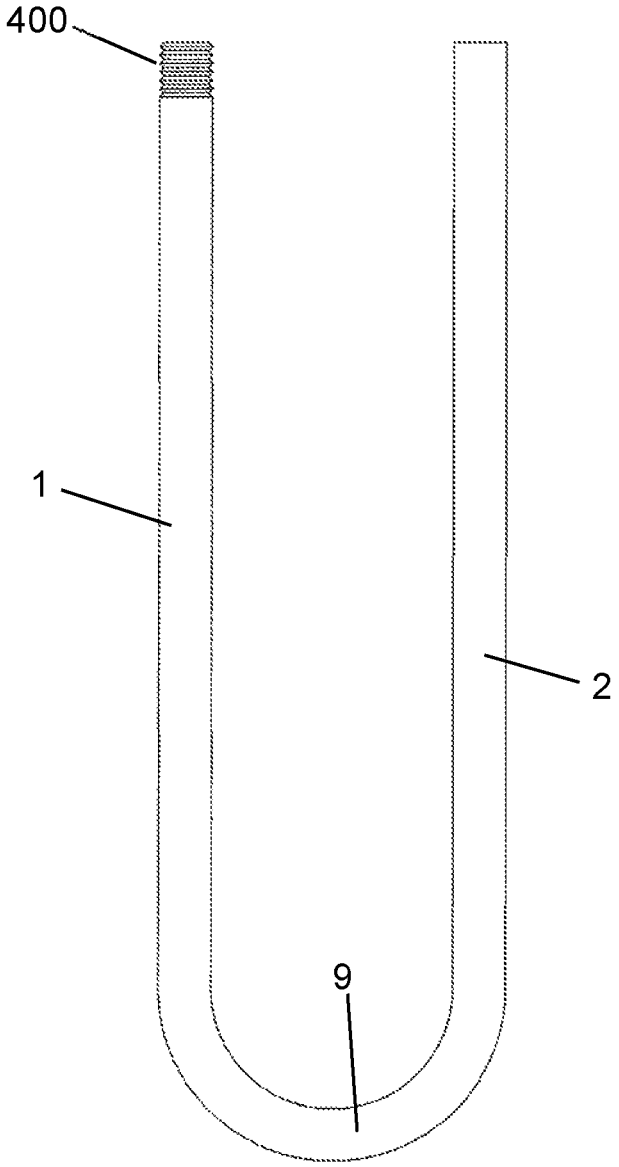
FIG. 4 is a side view of a U-shaped tube comprising a cylindrical axle shaft, an elongated handle shaft and a shaft connector used in the hand tool of FIG. 1A.

Particularly in reference to embodiments using a U-shaped tube, the axle shaft 1 portion of the tube may be referred to as a first leg 1, and the handle shaft 2 portion may be referred to as the second leg 2, and the shaft connector 9 may be referred to as a connecting portion 9 extending between and rigidly connecting the first and second legs 1, 2. The first and second legs 1, 2 preferably have approximately the same length. The first leg 1 is approximately straight, and the second leg 2 is preferably approximately straight. The first leg 1 is approximately parallel to the second leg 2, which includes embodiments where the second leg 2 is not entirely straight and not entirely tubular. For example, the second leg 2 may have a non-tubular grip portion integrally formed as part of the U-shaped tube. The connecting portion 9 is preferably curved, as shown in FIG. 4, but could be otherwise, such as being straight and perpendicular to the first and second legs 1, 2. In some non-preferred embodiments, the U-shaped tube may include portions that are not hollow, or may have no hollow portions, but it is still referred to as a "tube" herein. Furthermore, the U-shaped tube may have non-cylindrical portions, for example having an octagonal lateral cross-section, or be entirely non-cylindrical. In such embodiments, the inner surface of the cylindrical spindle hub 101 may not be cylindrical but rather may be configured to match the outer surface of the portion of the first leg 1 to which it is attached. The outer surface of the shaft tube 100 however must be cylindrical to facilitate rotation of the gripper sleeve bearing about the shaft tube 100. In some non-preferred embodiments, the spindle hub 101 may be integrally formed with the first leg 1. For example, the spindle hub 101 may be a portion of the first leg 1 including a retaining mechanism that constrains longitudinal movement of the rotatably attached gripper sleeve bearing, such as lateral protrusions spaced longitudinally apart by at least the length of the gripper sleeve bearing, where the spindle hub 101 is rigidly attached to the first leg 1 by virtue of being, other than possibly the retaining mechanism, integrally formed with (i.e. part of) the first leg 1. Similarly, although not preferred, the guide knob 3 may be integrally formed with the first leg 1, and may not have a strictly cylindrical outer surface. For example, the lateral cross-section of the guide knob 3 may be octagonal.

As used herein, the term "longitudinal", which is equivalent to "axial", refers to the direction of the central axis of a cylindrical body, including the roll 500, 600, core 700, core insert 103, spindle hub 101, shaft tube 100, spindle base 4, sleeve tube, gripper sleeve bearing 7, metal ring 6, core insert 103, axle shaft 1, guide knob 3, and, in some embodiments, the handle shaft 2. When the hand tool is assembled with a roll 500, 600 on the axle shaft 1, all of these longitudinal axes are approximately coincident except for the longitudinal axis of the handle shaft 2, which is approximately parallel to, but laterally spaced apart from, the longitudinal axes of the other elements. The axes will generally not be coincident or parallel when the individual elements are not attached to each other as parts of the finished hand tool. The only longitudinal axis that is numbered herein is the longitudinal axis 102 of the shaft tube 100, however, all references to a longitudinal axes herein, other than in reference to the handle shaft 2 and grip 8, refer to an axis that is approximately coincident with item 102 when the tool is assembled and has a roll 500, 600 on the axle shaft 1. In the drawings, other than FIG. 12, the longitudinal axis 102 is depicted as being vertical, but the axis of course rotates as the hand tool is rotated.

As used herein, the term "lateral" refers to a direction that is approximately perpendicular to the relevant longitudinal axis which, since all the longitudinal axes referenced herein are coincident or at least parallel, so that "longitudinal axis" in isolation should be interpreted to refer to the longitudinal axis of any element other than the handle shaft 2 of the finished hand tool.

As used herein, two elements being "rigidly" connected means that the elements are attached to each other so that are constrained to move together, and one element cannot be rotated relative to the other. Two or more rigidly connected elements may be integrally formed and are considered to be rigidly attached/connected to each other by virtue of their integral formation. In some instances, such elements may be identified by different names simply to permit separate reference to different portions of an integrated part such as the shaft tube 100 and spindle base 4 in an integrally formed spindle hub 101, although generally such a part may alternately be formed by mechanically connecting multiple elements (e.g. by welding or by using adhesive).

It should be understood that the above-described embodiments of the present invention, particularly, any "preferred" embodiments or preferred aspects of elements, are only examples of implementations, merely set forth for a clear understanding of the principles of the invention. Many variations and modifications may be made to the above-described embodiment(s) of the invention as will be evident to those skilled in the art. That is, persons skilled in the art will appreciate and understand that such modifications and variations are, or will be, possible to utilize and carry out the teachings of the invention described herein. Any embodiments described herein as "not preferred" are practical embodiments but are considered to be undesirable relative the preferred embodiments described herein.

Where, in this document, a list of one or more items is prefaced by the expression "such as" or "including", is followed by the abbreviation "etc.", or is prefaced or followed by the expression "for example", or "e.g.", this is done to expressly convey and emphasize that the list is not exhaustive, irrespective of the length of the list. The absence of such an expression, or another similar expression, is in no way intended to imply that a list is exhaustive. Unless otherwise expressly stated or clearly implied, such lists shall be read to include all comparable or equivalent variations of the listed item(s), and alternatives to the item(s), in the list that a skilled person would understand would be suitable for the purpose that the one or more items are listed.

The words "comprises" and "comprising", when used in this specification and the claims, are used to specify the presence of stated features, elements, integers, steps or components, and do not preclude, nor imply the necessity for, the presence or addition of one or more other features, elements, integers, steps, components or groups thereof.

The abbreviation mm as used herein refers to millimetres (or in the US, "millimeters"). The abbreviation cm as used herein refers to centimetres (or in the US, "centimeters"). The abbreviation m as used herein refers to metres (or in the US, "meters"). The unit "mil" means 0.001 inches (0.0254 mm).

Unless expressly stated or otherwise clearly implied herein, the conjunction "or" as used in the specification and claims shall be interpreted as a non-exclusive "or" so that "X or Y" is true when X is true, when Y is true, and when both X and Y are true, and "X or Y" is false only when both X and Y are false.

It will be appreciated by a skilled person that, where a device is described with multiple components having different and distinct functions and functionalities, such a device further includes any different assignment of functions and functionalities between and among the components that produces a like result. It will be further appreciated that a single component, whether or not explicitly named, recited, or described, may have the functionality ascribed to different components in addition to or in lieu of the operation of those components. It will be further appreciated that the functionality of a single component may be performed by multiple other components, whether or not explicitly named, recited, or described, in addition to or in lieu of the operation of the single component.

It will be appreciated by a skilled person that, where a series of actions, options, steps, or states are described in the context of a method, such a method further includes any different order or permutation of the actions, options, steps, or states that produces a like result. It will be further appreciated that different actions, options, steps, or states of such a method may be performed simultaneously, sequentially, or otherwise.

The terms "about" and "approximately" can be used to include any numerical value that can vary without changing the basic function of that value. It is used to indicate that a specified value should not be construed as a precise or exact value, and that some variation either side of that value is contemplated and within the intended ambit of the disclosure. When used with a range, "about" and "approximately" also disclose the range defined by the absolute values of the two endpoints, e.g., "about 2 to about 4" also discloses the range "from 2 to 4." Generally, the terms "about" and "approximately" may refer to plus or minus 5% of the indicated number. For example, unless otherwise stated or implied, "X is approximately equal to and not greater than Y" means that X is between (0.95 times Y) and Y, whereas "X is approximately equal to Y" means that X is between (0.95*Y). and (1.05*Y), unless a skilled person would understand otherwise in the context of the assertion.

Numerical values in the specification and claims of this application should be understood to include numerical values which are the same when reduced to the same number of significant figures and numerical values which differ from the stated value by less than the experimental error of conventional measurement technique of the type described in the present application to determine the value.

The scope of the claims that follow is not limited by the embodiments set forth in the description. The claims should be given the broadest purposive construction consistent with the description and figures as a whole.

What is claimed is:

1. A hand tool for applying material to a surface, the material being wound onto a hollow cylindrical core to form a roll having an outer diameter and a longitudinal axis, the core having proximal and distal ends, an inner diameter and a length, the hand tool comprising:

a core insert comprising;

a spindle hub comprising a hollow cylindrical shaft tube having a length, proximal and distal ends, a constant inner diameter, a constant outer diameter, and a longitudinal axis, and a hollow cylindrical spindle base rigidly attached to the shaft tube, the spindle base having an inner diameter equal to the inner diameter of the shaft tube and having an outer diameter greater than the outer diameter of the shaft tube;

a gripper sleeve bearing comprising a hollow cylindrical sleeve tube having a longitudinal axis, and having attached a plurality of external axial splines aligned with the longitudinal axis and extending away from the longitudinal axis by a varying distance from an outer surface of the sleeve tube, the gripper sleeve bearing having a length less than the length of the shaft tube, proximal and distal ends, a constant inner diameter greater than the outer diameter of the shaft tube and less than the outer diameter of the spindle base, and a longitudinal axis, wherein each spline is tapered so that towards the proximal end of the gripper sleeve bearing the spline extends from the longitudinal axis by a distance greater than half of the inner diameter of the core and towards the distal end of the gripper sleeve bearing the spline extends from the longitudinal axis by a distance less than half of the inner diameter of the core, wherein the shaft tube is inserted into the gripper sleeve bearing so that the longitudinal axis of the gripper sleeve bearing is coincident with the longitudinal axis of the shaft tube, the proximal end of the gripper sleeve bearing is proximate to the spindle base, and the gripper sleeve bearing is rotatable about the shaft tube; and a retaining mechanism configured to retain the gripper sleeve bearing in rotational engagement with the shaft tube;

a cylindrical axle shaft having a length, a longitudinal axis, an outer diameter less than the inner diameter of the core and less than the inner diameter of the shaft tube, and having proximal and distal ends, wherein the axle shaft is inserted into the shaft tube wherein the spindle hub is rigidly attached to the axle shaft;

an elongated handle shaft spaced apart from the axle shaft by more than half of the outer diameter of the roll and having a length, proximal and distal ends, and a longitudinal axis approximately parallel to the longitudinal axis of the axle shaft;

a shaft connector having proximal and distal ends with the distal end of the shaft connector being rigidly connected to the proximal end of the handle shaft and the proximal end of the shaft connector being rigidly connected to the proximal end of the axle shaft; and a cylindrical guide knob rigidly attached to the distal end of the axle shaft, the guide knob having proximal and distal ends and a maximum diameter less than the inner diameter of the core, wherein the ends of the guide knob are tapered to a diameter less than the maximum diameter of the guide knob towards the proximal and distal ends of the guide knob, wherein the maximum diameter of the guide knob is sufficiently close to the inner diameter of the core to constrain lateral movement of the core and the roll when the axle core shaft is inserted into the core so as to maintain approximate coincidence of the longitudinal axes of the roll and the axle shaft, wherein the axle shaft is insertable into the core of the roll with the longitudinal axes of the roll and axle shaft being approximately coincident, and with the gripper sleeve bearing inserted into the core sufficiently far to releasably and frictionally engage the core so that the roll is rotatable about the axle shaft and shaft tube along with the gripper sleeve bearing.

2. The hand tool of claim 1, wherein the guide knob has internal threading for removable attachment to corresponding threading on an outer surface of the axle shaft-near the distal end of the axle shaft.

3. The hand tool of claim 1, wherein the length of the axle shaft-is selected so that when the axle shaft is inserted into the core with the gripper sleeve bearing frictionally engaged with the proximal end of the core, no portion of the axle shaft or guide knob protrudes from the distal end of the core.

4. The hand tool of claim 1, wherein the proximal end of the shaft connector is tubular and has an outer diameter equal to the outer diameter of the axle shaft.

5. The hand tool of claim 1, wherein the length of the handle shaft is approximately equal to the length of the axle shaft.

6. The hand tool of claim 1, wherein the axle shaft, shaft connector and handle shaft are integrally formed in a U shape.

7. The hand tool of claim 6, wherein the integrally formed axle shaft, shaft connector and handle shaft are a lightweight metal tube.

8. The hand tool of claim 7, wherein the metal is aluminum.

9. The hand tool of claim 1, further comprising a grip attached to the handle shaft encircling a portion of the handle shaft and configured to facilitate a user holding the hand tool by the grip.

10. The hand tool of claim 9, wherein the grip is movable along the longitudinal axis of the handle shaft.

11. The hand tool of claim 1, wherein the material is pre-taped masking film.

12. A hand tool for applying material to a surface, the material being wound onto a hollow cylindrical core to form a roll, the core having an inner diameter, proximal and distal ends, and a length, the hand tool comprising:

a U-shaped tube having approximately straight first and second legs, the first leg having a longitudinal axis and being approximately parallel to the second leg, and a connecting portion extending between the first and second legs;

a guide knob encircling the longitudinal axis of the first leg that is rigidly attached to an end of the first leg, the guide knob having a diameter approximately equal to and not greater than the inner diameter of the core;

a spindle hub rigidly attached to the first leg and longitudinally spaced apart from the guide knob; and a cylindrical gripper sleeve bearing rotatably connected to the spindle hub, the gripper sleeve bearing having a varying diameter that increases from (a) a distal diameter that is less than the inner diameter of the core at an end nearest to the guide knob to (b) a proximal diameter that is greater than the inner diameter of the core at an end furthest from the guide knob, wherein the first leg is insertable into the core so that the gripper sleeve bearing is partially inserted into the proximal end of the core and frictionally engages the core so that the roll is rotatable about the axle shaft with the gripper sleeve bearing, and wherein the guide knob is spaced apart from the gripper sleeve bearing so that when the first leg is inserted into the core with the gripper sleeve bearing frictionally engaged with the core, no portion of the first leg or guide knob protrudes out of the distal end of the core.

13. The hand tool of claim 12, further comprising a grip attached to the second leg encircling a portion of the second leg, wherein the grip is configured to facilitate a user holding the hand tool by the grip.

* * * * *